US009962963B2

(12) United States Patent
De Roeck

(10) Patent No.: US 9,962,963 B2
(45) Date of Patent: May 8, 2018

(54) LARGE INKJET FLATBED TABLE

(71) Applicant: AGFA NV, Mortsel (BE)

(72) Inventor: Luc De Roeck, Mortsel (BE)

(73) Assignee: AGFA NV, Mortsel (BE)

( * ) Notice: Subject to any disclaimer, the term of this patent is extended or adjusted under 35 U.S.C. 154(b) by 0 days. days.

(21) Appl. No.: 15/517,209

(22) PCT Filed: Oct. 22, 2015

(86) PCT No.: PCT/EP2015/074523

§ 371 (c)(1),
(2) Date: Apr. 6, 2017

(87) PCT Pub. No.: WO2016/071122

PCT Pub. Date: May 12, 2016

(65) Prior Publication Data

US 2017/0305172 A1 Oct. 26, 2017

(30) Foreign Application Priority Data

Nov. 4, 2014 (EP) ..... 14191640

(51) Int. Cl.
*B41J 11/00* (2006.01)
*B41J 2/01* (2006.01)

(52) U.S. Cl.
CPC ..... *B41J 11/0085* (2013.01); *B41J 2/01* (2013.01)

(58) Field of Classification Search
CPC ..... B41J 11/0085; B41J 2/01; B65H 5/00
See application file for complete search history.

(56) References Cited

U.S. PATENT DOCUMENTS 4,540,990 A 9/1985 Crean
8,287,120 B2 * 10/2012 Murata ..... B41J 11/007 347/101
2002/0167578 A1 11/2002 Miki et al.
2006/0261298 A1 11/2006 Matsumoto
2007/0070099 A1 3/2007 Beer et al.

FOREIGN PATENT DOCUMENTS

DE 199 29 266 A1 12/2000
EP 1 721 753 A2 11/2006
JP 2004-122554 A 4/2004
JP 3707640 B2 10/2005
JP 2009-083512 A 4/2009

OTHER PUBLICATIONS

Official Communication issued in International Patent Application No. PCT/EP2015/074523, dated Dec. 18, 2015.

* cited by examiner

*Primary Examiner* — Thinh H Nguyen
(74) *Attorney, Agent, or Firm* — Keating and Bennett, LLP

(57) ABSTRACT

A method of manufacturing of an inkjet flatbed table including a large support layer with an area of at least 1.5 $m^2$ to support an ink receiver in an inkjet printing system, the method including the steps of fixing a plate on top of a base unit by forming a part of or whole the support layer; and abrading the fixed plate to have a flatness on the top of the support layer less than 300 μm and wherein the plate is characterized by including a thermoplastic polymer resin.

15 Claims, 7 Drawing Sheets

LARGE INKJET FLATBED TABLE

CROSS REFERENCE TO RELATED APPLICATIONS

This application is a 371 National Stage Application of PCT/EP2015/074523, filed Oct. 22, 2015. This application claims the benefit of European Application No. 14191640.3, filed Nov. 4, 2014, which is incorporated by reference herein in its entirety.

BACKGROUND OF THE INVENTION

1. Field of the Invention

The present invention relates to a large inkjet flatbed table and especially the manufacturing of a large inkjet flatbed table for an inkjet printing system to have a flatness on the top of the inkjet flatbed table smaller than 300 μm.

2. Description of the Related Art

The availability of better performing printheads, such as less drop-outs and failing nozzles, and the lower cost of printheads, the maximum printing size of inkjet printing system is enlarged to print on large or multiple ink receivers (300, 305) such as wood or textile. To support these large or multiple ink receivers, a large inkjet flatbed table has to be manufactured. A maximum use of the large inkjet flatbed table results in a higher amount of print jobs and better productivity which is economically beneficial.

The printing of large ink receivers exists in the state-of-the-art such as the INCA™ Onset S40 or Agfa Graphics™: M-PRESS TIGER which are capable to handle very large ink receivers for sign & display print jobs and HYMMEN™ JPT-L for printing furniture panels, doors, laminate floorings or façade elements or REGGIANI MACHINE™ ReNOIR for printing on fabric web with a maximum web-width up to 3.40 m or DIEFFENBACHER™ Colorizer for furniture production with formats up to 2.070 mm×3.600 mm.

To print on such large ink receivers or multiple ink receivers it is a challenge to have a very flat inkjet flatbed table. It is known that the topology (=height differences) of an inkjet flatbed table influences the print quality because the throw distance depends on the height differences between ink receiver and printhead. The throw distance is defined as the distance from the printhead to the ink receiver. It is a function of many factors including: the jet velocity, the printhead flight path, the variation in jet velocities across the array, nozzle straightness, drive position errors, air turbulence, printhead perpendicularity and alignment, timing errors, and nozzle pitch variation.

The support layer of the state-of-the-art inkjet flatbed tables is metal or stainless metal which results in a higher weight of the inkjet flatbed table and difficult handling by its weight while manufacturing. Another disadvantage of a metal support layer is the difficulty and the cost of abrasion to a flatness less than 300 μm, especially for large inkjet flatbed tables. The worse slidability of a metal support layer to transport the ink receiver underneath a printhead of the inkjet printing system is due to the higher surface roughness of a metal support layer also a disadvantage. The frictional resistance can be lowered by anodizing or coating the metal support layer after abrading which results unfortunately in less flatness of the support layer and a higher cost of the inkjet flatbed table or before abrading which results in bad anodized/coated areas after the abrading step.

In the state-of-the-art these height differences of the inkjet flatbed table is solved my measuring the topology of the inkjet flatbed table. A sensor is used to scan the table and produce a topological map. This map is used to alter the timing of firing ink drops so that they land at the appropriate location on the media despite the height differences on the top of the inkjet flatbed table. This method is disclosed in U.S. Pat. No. 4,540,990 (XEROX CORPORATION) and US2007070099 (APPLIED MATERIALS INC). In addition to the high cost of the sensor, complicated time-of-firing-ink drops algorithms and the measurement of the topology that takes to much time makes this method ineffective in high production printing such as industrial inkjet printing.

EP1721753 (AGFA GRAPHICS) discloses an inkjet flatbed table comprising a plurality of small table segments of which height and orientation can be adjusted by adjustments screws or bolts, to have a flat large inkjet flatbed table. The time of alignment for all these table segments takes to much time and the high cost of adjustments screws or bolts makes this inkjet flatbed table has high costs to become economical useful for industrial inkjet printing.

Hence, there is still a need for an improved method for manufacturing a large inkjet flatbed table and having a large inkjet flatbed table with low cost, easy handling for building up an inkjet printing system, low weight and having a flatness less than 300 μm to support large ink receivers and/or multiple ink receivers.

SUMMARY OF THE INVENTION

In order to overcome the problems described above, preferred embodiments of the present invention have been realised with a method for manufacturing an inkjet flatbed table as defined below. The result of the method is an inkjet flatbed table as defined below.

Further advantages and preferred embodiments of the present invention will become apparent from the following description.

DETAILED DESCRIPTION OF THE PREFERRED EMBODIMENTS

Figure 1:
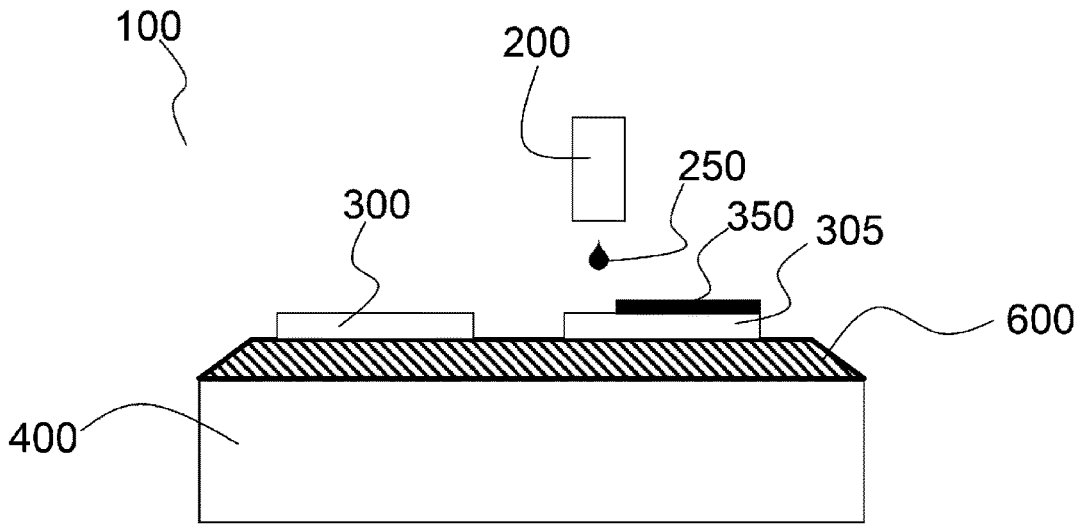
FIG. 1 illustrates a cross-section from a preferred embodiment of an inkjet flatbed table, with a support layer of at least 1.5 $m^2$, attached in an inkjet printer system (100), which is not visible in the figure. On the support layer an unprinted ink receiver (300) is laid down and a partially printed ink receiver (305) is laid down. The partially printed ink receiver (305) is printed by jetting an ink (250) via a printhead (200) to form an ink layer (350) on the ink receiver (305). The support layer is a plate (600) fixed to the base unit (400) of the inkjet flatbed table. The plate (600) comprises a thermoplastic polymer resin.

Preferred embodiments of the present invention include manufacturing of an inkjet flatbed table which comprises a large support layer with an area of at least 1.5 $m^2$ to support an ink receiver (300, 305) in an inkjet printing system, comprising the following steps:

fixing a plate (600) on top of a base unit (400) by forming a part of or whole the support layer; and abrading the fixed plate (600) to have a flatness on the top of the support layer less than 300 μm and wherein the plate (600) is characterized by comprising a thermoplastic polymer resin or the plate (600) is made of a thermoplastic polymer resin.

The flatness on the top of the support layer is crucial to have good print quality on an ink receiver (300, 305) which is supported on the support layer because it influences the throw distance. The larger the inkjet flatbed table the more difficult to result in a flatness less than 300 μm. In a preferred embodiment the area of the support layer is at least 2.5 $m^2$. The plate (600) may have any shape but is preferably rectangular shaped.

Preferably the step of abrading in the present invention comprises the step of milling and/or grinding. The step of milling is more preferred because a step of grinding takes more time and expensive to abrade the plate. The abrading of a metal support layer from the state-of-the-art inkjet flatbed tables may cause metal burrs which can be sharp and damage the backside of the ink receiver (300, 305), instead of the abrading of a support layer comprising a thermoplastic polymer resin which causes chips. These chips can easily be blown away from the inkjet flatbed table. The tools for abrading are preferably cooled why milling or grinding.

The weight of a support layer comprising thermoplastic polymer resin instead of a state-of-the-art support layer made of metal is an advantage in the total weight of the inkjet flatbed table to handle the inkjet flatbed table easier while manufacturing or attaching it to an inkjet printing system.

After fixing of the plate, the height differences are preferably measured prior the abrading or more preferably during the abrading.

In a preferred embodiment the flatness on the top of the support layer is between 3 μm and 100 μm, more preferably between 5 μm and 50 μm and most preferably less than 20 μm. The smaller the flatness of the support layer, the better the throw distance and thus better the print quality.

Because the plate (600) comprises a thermoplastic polymer resin, is made of thermoplastic polymer resin or is a thermoplastic polymer composition, the abrading and milling is facilitated versus a support layer made of metal. The timing for abrading and energy cost in the present invention is smaller and cheaper than on metal support layers.

An advantage of using a plate (600) comprising a thermoplastic resin is the ease of milling air sucking apertures or air blowing sucking apertures, if the inkjet flatbed table is a porous inkjet flatbed table. The apertures may also be extruded in the plate. In a preferred embodiment milled air sucking apertures are distributed over the plate (600) to achieve a well distributed vacuum over the whole plate (600).

The abrading of the fixed plate (600) may be performed by a milling cutter comprising a probe to measure the height of the fixed plate (600) while abrading or milling. Such a probe may be contact-less or a touch probe.

The thickness of the plate (600) is preferably between 0.5 mm and 250 mm to have enough latitude for the abrading step and to have enough stiffness of the plate. The thickness of the plate (600) is more preferably between 1 mm and 50 mm.

In a preferred embodiment, the elongation of an aperture, such as air sucking aperture and air blowing sucking aperture, is in a direction along the length of the inkjet flatbed table, especially when the aperture is a groove, to have a good connection of the ink receiver (300, 305) to the inkjet flatbed table via the air sucking apertures.

Figure 2:
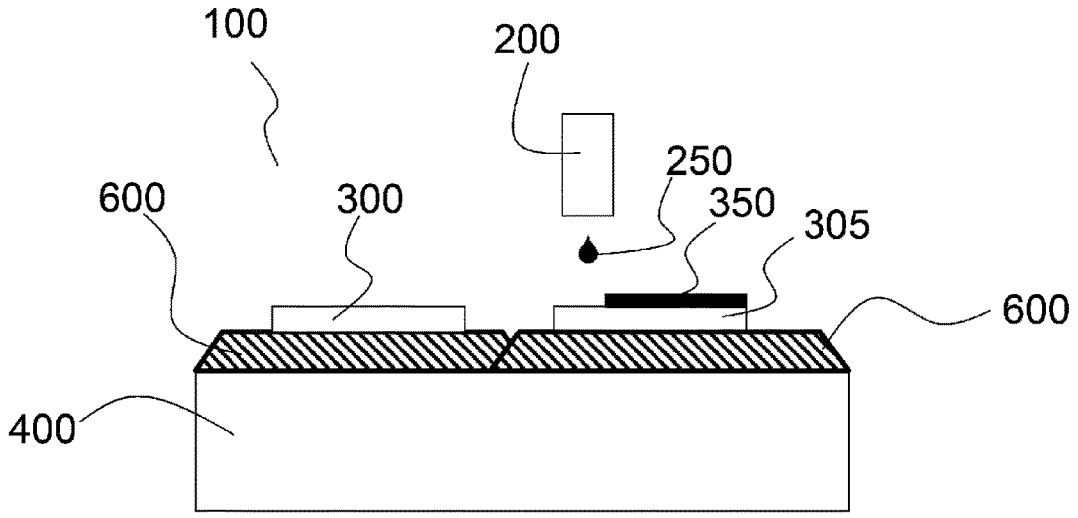
FIG. 2 illustrates a cross-section from a preferred embodiment of an inkjet flatbed table, with a support layer of at least 1.5 $m^2$, attached in an inkjet printer system (100), which is not visible in the figure. On the support layer an unprinted ink receiver (300) is laid down and a partially printed ink receiver (305) is laid down. The partially printed ink receiver (305) is printed by jetting an ink (250) via a printhead (200) to form an ink layer (350) on the ink receiver (305). The support layer comprises two plates (600) fixed to the base unit (400) of the inkjet flatbed table. The plates (600) comprise a thermoplastic polymer resin.
Figure 3:
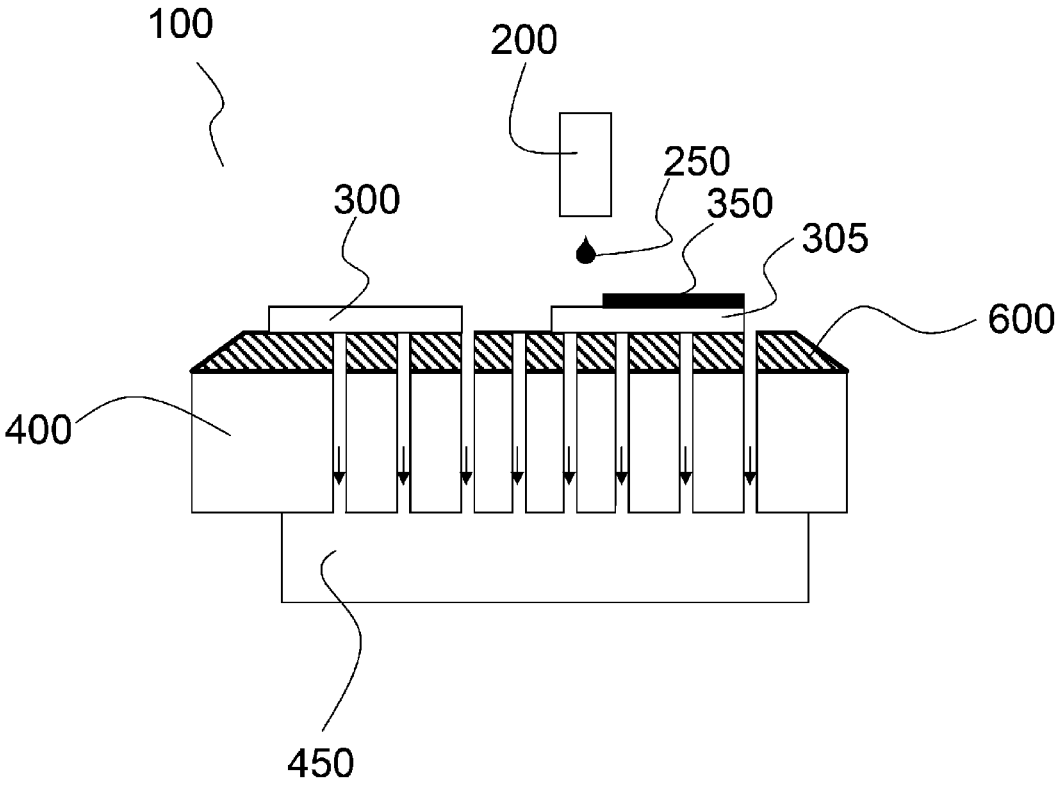
FIG. 3 illustrates a cross-section from a preferred embodiment of an inkjet flatbed table, with a support layer of at least 1.5 $m^2$, attached in an inkjet printer system (100), which is not visible in the figure. On the support layer an unprinted ink receiver (300) is laid down and a partially printed ink receiver (305) is laid down. The partially printed ink receiver (305) is printed by jetting an ink (250) via a printhead (200) to form an ink layer (350) on the ink receiver (305). The support layer comprises a plate (600) fixed to the base unit (400) of the inkjet flatbed table. The plate (600) comprises a thermoplastic polymer resin. Underneath the base unit (400) a vacuum chamber (450) is attached to suck air from a plurality of air-sucking channels in the direction of the arrows to connect the ink receivers (300, 305) to the ink printing table.

In a preferred embodiment the inkjet flatbed table comprises a plurality of fixed plates (FIG. 2) which each comprises a thermoplastic polymer resin or are made of thermoplastic polymer. To manufacture such a large area of the support layer on the inkjet flatbed table from the present invention, it is much easier to fix multiple smaller plates than handling one big plate (600) to cover the whole base unit (400) of the inkjet flatbed table to form such a large area. Also the bending of one big plate (600) is more difficult to control than a plurality of plates (600) when it is fixed on top of the base unit (400). One extruded big plate (600) to form a support layer larger than 1.5 $m^2$ is a challenge so multiple smaller plates, which are easier to extrude, is an advantage in this preferred embodiment.

In a preferred embodiment the fixing-step of the plate (600) comprises the step of gluing and/or screwing the plate (600) on top of the base unit (400). Gluing of the plate (600) is preferred to have a correct and stable flatness which is not guaranteed if a plate (600) is changeable by another plate (600). On the other hand the possibility to remove the plate (600) by another plates makes the inkjet flatbed table flexible for example to change the apertures in the plate, such as the amount or shape of air sucking apertures. The apertures for screwing the plate (600) are preferably extruded in the plate.

If the plate (600) is glued, the plate (600) preferably comprises at the side which is glued on top of the base unit (400), glue grooves to hold the glue positioned while gluing. The glue grooves are milled or extruded on this side. The edges of a plate (600) may in the present invention provided with glue to fix the plate (600) on top of the base unit (400). The glue is preferably epoxy glue which has, after curing preferably, high chemical resistance, high UV (ultra-violet) resistance, high thermal shock resistance, high mechanical, high electrical and/or high impact resistant properties. It is an advantage to have such resistant glue because ink may be spilled or jetted on the dried glue from the support layer of the inkjet flatbed table or if the inkjet printing system comprises an UV curing lamp, the dried glue is subject to UV light and temperature changes.

It is an advantage if the plate (600) has a high chemical resistance, high UV (ultra-violet) resistance, high thermal shock resistance, high mechanical resistance, easy machinable (for milling/grinding), low liquid absorbance, high electrical and/or high impact resistant properties which is achievable when the plate (600) comprises a thermoplastic polymer, such as engineering plastic compositions and in a preferred embodiment polyethylene terephthalate (PET), polyamide (PA), high-density polyethylene (HDPE), polytetrafluoroethylene (PTFE), polyoxymethylene (POM) and/or Polyaryletherketone (PAEK), whereof polyethylene terephthalate (PET) is most preferred, due its wear resistance, wet or dry, chemical resistance, and medium cost range. PET also remains stiffer at higher temperatures than plates comprising other thermoplastic polymer resins. The high resistance properties for a support layer are an advantage because the support layer is support to ink spilling, weight of ink receivers (300, 305), temperature changing's, and/or UV light. The plate (600) may also comprise aliphatic polyamides, polyamide 11 (PA 11), polyamide 12 (PA 12), UHM-HDPE, HM-HDPE, Polypropylene (PP), Polyvinyl chloride (PVC), Polysulfone (PS), Poly(p-phenylene oxide) (PPO™), Polybutylene terephthalate (PBT), Polycarbonate (PC), Polyphenylene sulphide (PPS).

In a preferred embodiment the material of the plate (600) is chosen to have a high chemical resistance, high UV (ultra-violet) resistance, high thermal shock resistance, high mechanical resistance, low liquid absorbance, high electrical and/or high impact resistant properties. The plate of the present invention comprises or is preferably an engineering plastic composition (http://en.wikipedia.org/wiki/Engineering_plastic).

In a preferred embodiment the plate comprises a semi-crystalline thermoplastic or is a semi-crystalline thermoplastic composition. Due to the crystalline areas, the plate is extremely tough (strong intermolecular forces) and is capable of withstanding mechanical loads also above the glass transition temperature.

In a preferred embodiment the plate is polyethylene terephthalate (PET) composition, polyamide (PA) composition, high-density polyethylene (HDPE) composition, polytetrafluoroethylene (PTFE) composition, polyoxymethylene (POM) composition or Polyaryletherketone (PAEK) composition, whereof polyethylene terephthalate (PET) composition is most preferred, due its wear resistance, wet or dry, chemical resistance and medium cost range.

The material of the plate (600) has to be chosen to have a low friction with the backside of ink receivers or porous conveyor belt when wrapped around the inkjet flatbed table. In a preferred embodiment therefore the plate comprises Teflon.

To manufacture an inkjet flatbed table as a light weight inkjet flatbed table, the base unit (400) comprises a honeycomb structure plate (430) (FIG. 0.5). The advantage is not only the light weight but also the already flatness of the top from the base unit (400) and a high stiffness in several directions on the top from the base unit (400) so the forces caused by the support of the ink receivers (300, 305) are distributed over the surface area of the support layer from the inkjet flatbed table. A light weight inkjet flatbed table makes it easier to handle while manufacturing or connecting the manufactured inkjet flatbed table in an inkjet printing system, especially when the support layer is at least 1.5 $m^2$.

Before abrading the fixed plate, the base unit (400) is preferably aligned on a set of reference points which are comprised in the base unit (400). These reference points determine a reference plane. In a preferred embodiment of the manufacturing of an inkjet flatbed table comprises further the step of abrading the fixed plate (600) to have a support layer parallel to a reference plane which is determined by a set of reference points in the base unit (400). These reference points may be used while manufacturing the inkjet printing system in the step of attaching the inkjet flatbed table of the present invention, to have a correct flat inkjet flatbed table, for example parallel to the ground. If the inkjet printing system comprises a gantry with a set of printheads (200), the gantry is preferably also aligned to the plane of the set of reference points. The number of reference points is preferably three so a reference plane can be determined.

The inkjet flatbed table may also, after manufacturing, be parallel towards the plane wherein a nozzle plate of a printhead is mounted or is moving above the inkjet flatbed table.

To have a good connection of an ink receiver (300, 305) on the inkjet flatbed table, the inkjet flatbed table may be a porous inkjet flatbed table. The manufacturing of a porous inkjet flatbed table comprises preferably the step of attaching a vacuum chamber underneath the inkjet flatbed table (FIG. 3, FIG. 5, FIG. 6, FIG. 7) suitable for creating a vacuum pressure between an ink receiver (300, 305) and the inkjet flatbed table by air sucking through an air-suck channel attached to a first aperture in the plate (600) and a first aperture in the base unit (400). To hold down the ink receiver (300, 305), especially when the ink receiver (300, 305) curls or comprises bends, is advantage to have no small height differences between the ink receiver (300, 305) and the printhead (200) to have a better throw distance which results in a better print quality. It is also an advantage of avoiding ink receiver (300, 305) collisions against a printhead (200).

Figure 4:
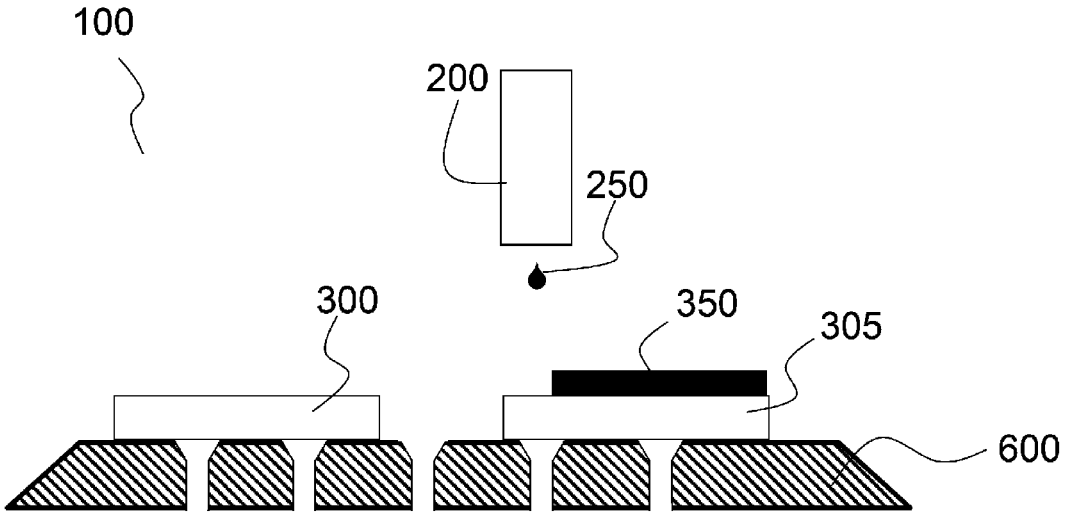
FIG. 4 illustrates a cross-section from a preferred embodiment of an inkjet flatbed table, with a support layer of at least 1.5 $m^2$, attached in an inkjet printer system (100), which is not visible in the figure. On the support layer an unprinted ink receiver (300) is laid down and a partially printed ink receiver (305) is laid down. The partially printed ink receiver (305) is printed by jetting an ink (250) via a printhead (200) to form an ink layer (350) on the ink receiver (305). The support layer comprises a plate (600) fixed to the base unit (400) of the inkjet flatbed table. The plate (600) comprises a thermoplastic polymer resin. In the plate (600) a plurality of air-sucking apertures are extruded wherein at the entrance of the air-sucking apertures are chamfered. The vacuum chamber is not visible in this figure.
Figure 5:
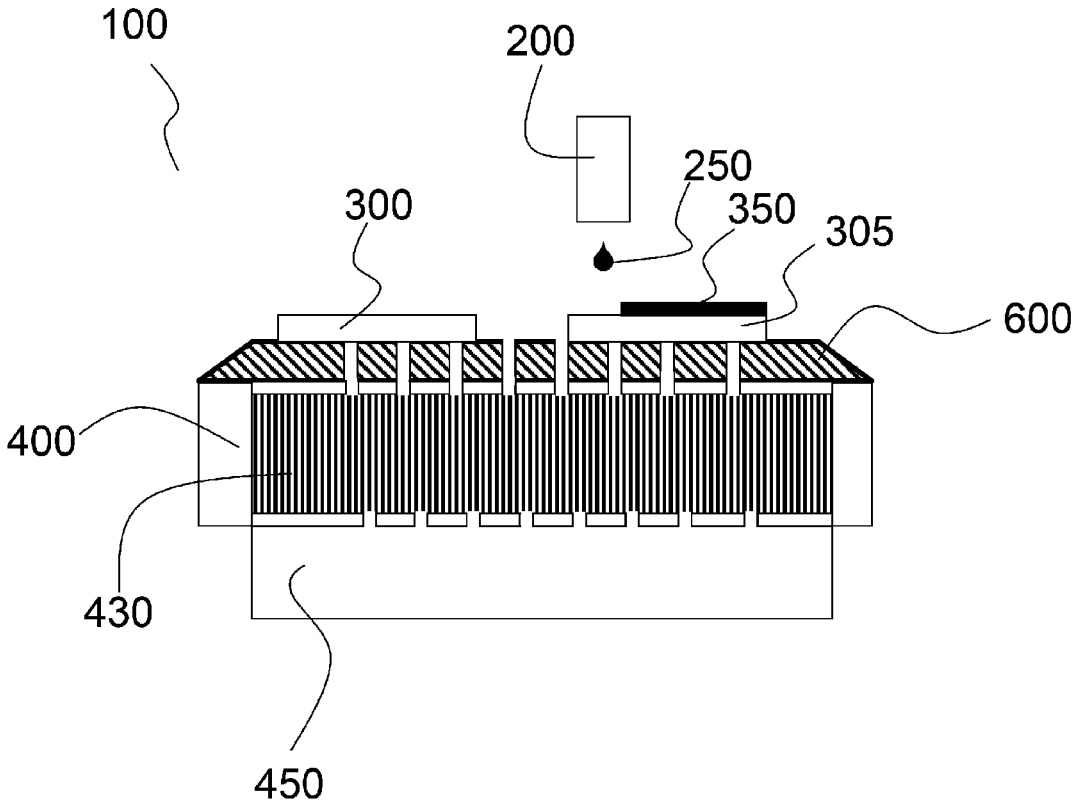
FIG. 5 illustrates a cross-section from a preferred embodiment of an inkjet flatbed table, with a support layer of at least 1.5 $m^2$, attached in an inkjet printer system (100), which is not visible in the figure. On the support layer an unprinted ink receiver (300) is laid down and a partially printed ink receiver (305) is laid down. The partially printed ink receiver (305) is printed by jetting an ink (250) via a printhead (200) to form an ink layer (350) on the ink receiver (305). The support layer comprises a plate (600) fixed to the base unit (400) of the inkjet flatbed table. The plate (600) comprises a thermoplastic polymer resin. Underneath the base unit (400) a vacuum chamber is attached to suck air from a plurality of air-sucking channels to connect the ink receivers (300, 305) to the ink printing table. The base unit (400) comprises a honeycomb structure plate (430) sandwiched by a metal top plate and metal bottom plate.

To avoid scratches or damages on the back of the ink receiver (300, 305), which is connected to the support layer, apertures, such as air-sucking apertures or air-blowing apertures, comprises preferably chamfered outlets at the top of the plate (600) so the dimension of the aperture is larger at the top of the plate (600) than inside the aperture (FIG. 4). If an aperture is milled, the edges of apertures may have small sharp milling traces, also called metal burrs, at the edge which may damage the back of the ink receiver (300, 305), therefore a chamfered outlet is advantage to have no scratches and damages at the back of the ink receiver (300, 305). The angle of chamfered apertures is preferably between 15 and 75 degrees and more preferably between 30 and 60 degrees.

Figure 6:
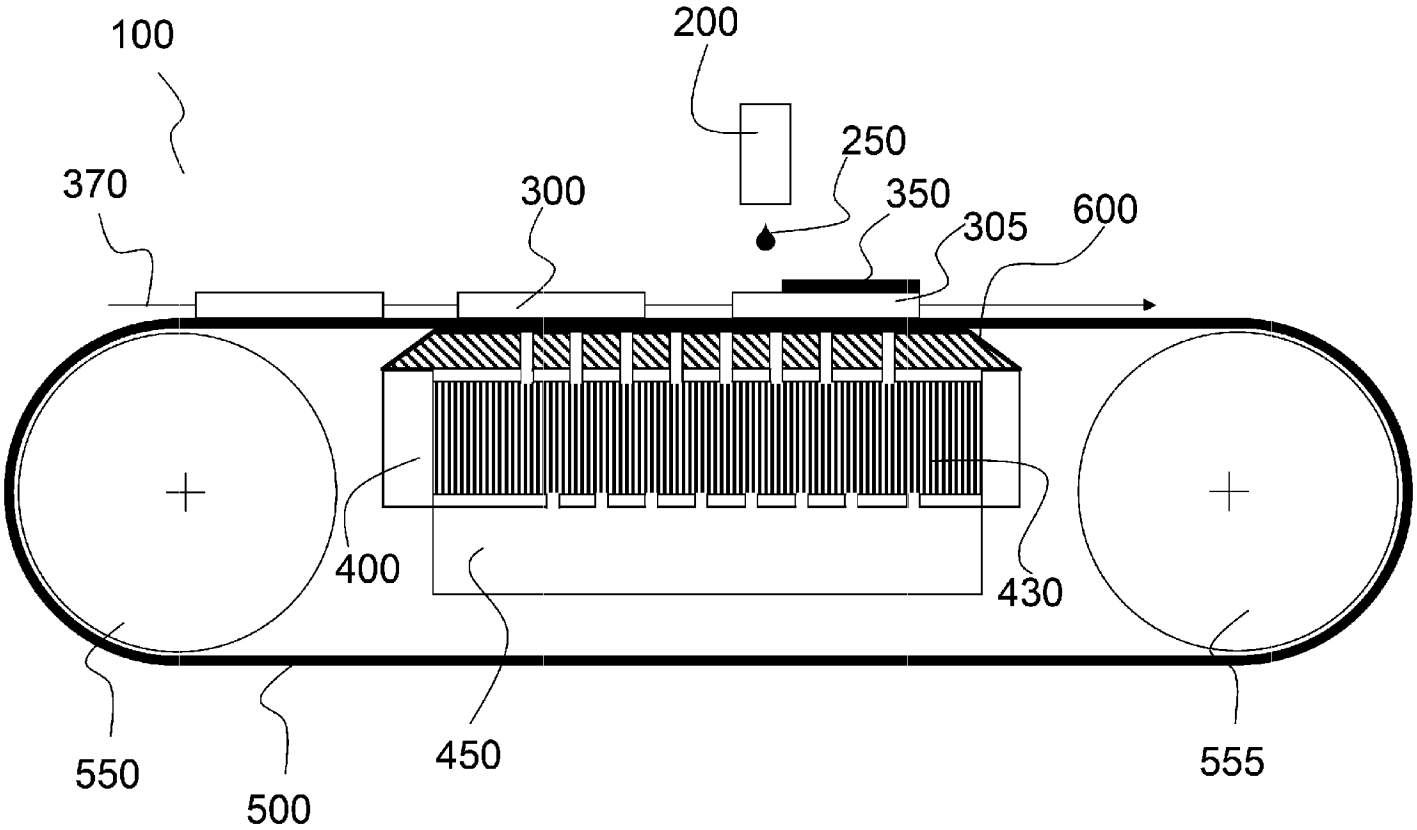
FIG. 6 illustrates the same cross-section as FIG. 5 but wherein the inkjet flatbed table, with a support layer of at least 1.5 $m^2$, is wrapped around by a porous conveyor belt (500) which is linked to a powered pulley (555) and a non-powered pulley (550). By rotating the powered pulley (555) the ink receivers (300, 305) are transported in the direction of the arrow which is the transport direction (370).
Figure 7:
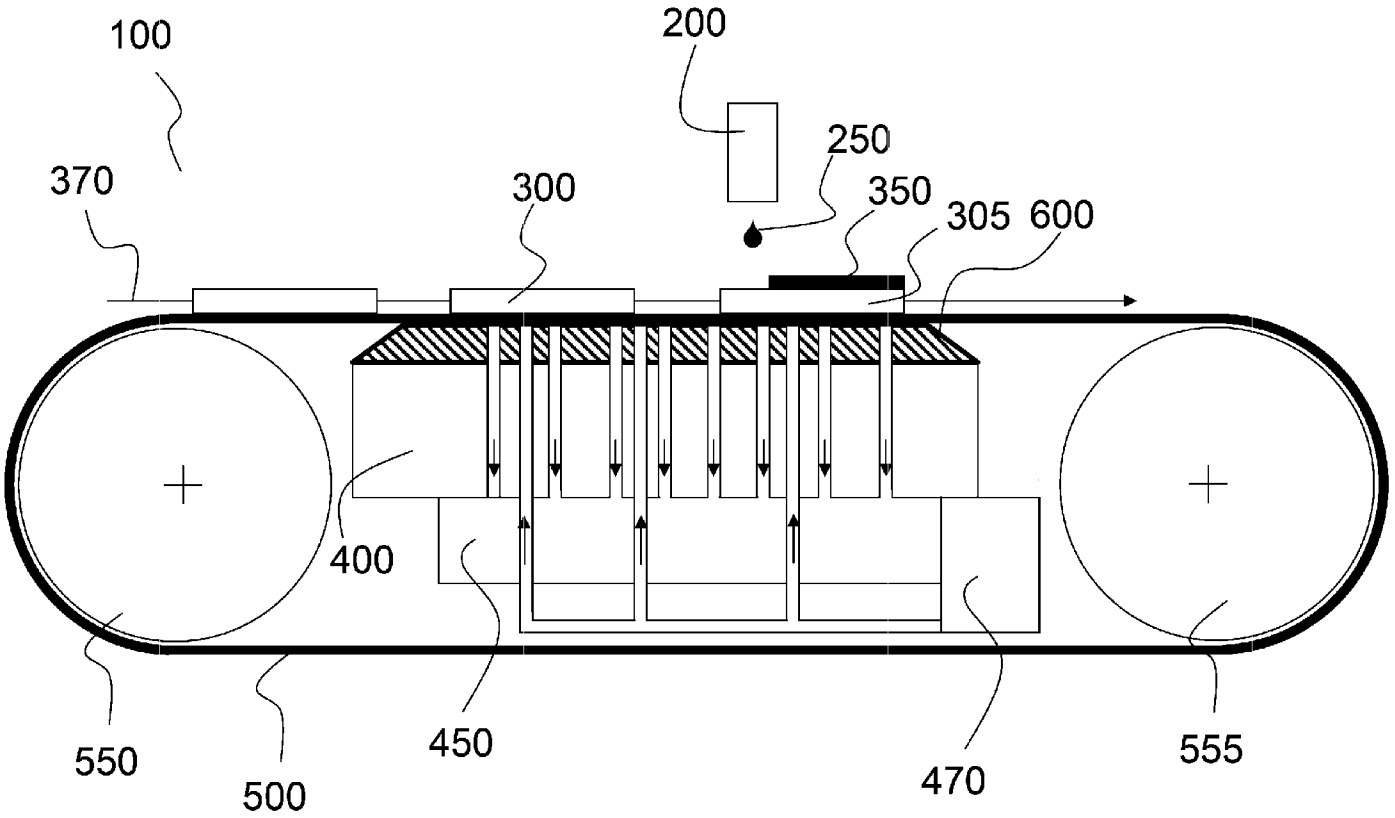
FIG. 7 illustrates the same cross-section as FIG. 3 but wherein the inkjet flatbed table, with a support layer of at least 1.5 $m^2$, is wrapped around by a porous conveyor belt (500) which is linked to a powered pulley (555) and a non-powered pulley (550). By rotating the powered pulley (555) the ink receivers (300, 305) are transported in the direction of the arrow which is the transport direction (370). Underneath the base unit (400) also an air-blow chamber (470) is attached to blow air through air-blowing channels through the plate (600) to lower the friction of the porous conveyor belt (500) and the plate (600) while transporting the ink receivers (300, 305).
Figure 8:
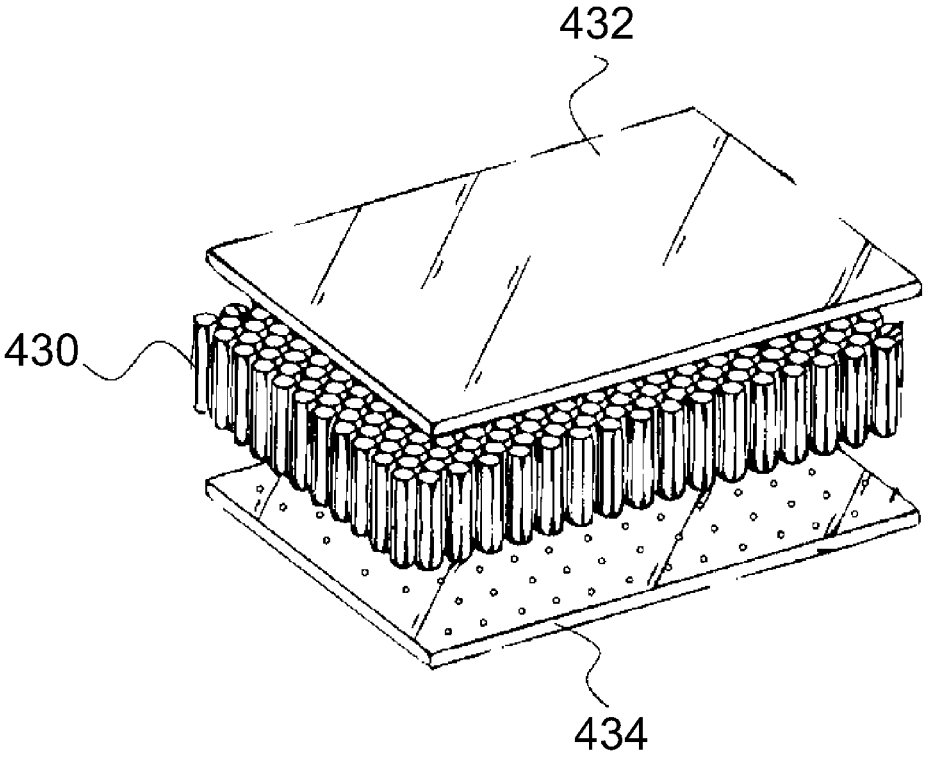
FIG. 8 illustrates a base unit (400) of an inkjet flatbed table, with a support layer of at least 1.5 $m^2$, which is not visible. The base unit (400) from a preferred embodiment comprises a honeycomb structure plate (430) sandwiched by a metal top plate (432) and a metal bottom plate (434).

The manufacturing of a porous inkjet flatbed table may comprise the step of wrapping a porous conveyor belt (500) around the inkjet flatbed table wherein the porous conveyor belt (500) which is linked to a plurality of pulleys (550, 555) (FIG. 6, FIG. 7). The porous conveyor belt (500) may serve than as a transport system of the ink receiver (300, 305) underneath a printhead (200) of an inkjet printing system To avoid scratches or damages on the back of the porous conveyor belt (500), apertures, such as air-sucking apertures or air-blowing apertures, comprises chamfered outlets at the top of the plate (600) so the dimension of the aperture at the top of the plate (600) is larger than inside the aperture. If an aperture is milled, the edges of apertures may have small sharp traces at the edge which may damage the back of the ink receiver (300, 305) or porous conveyor belt (500), therefore chamfered outlets is advantage to have no scratches and damages at the back of the ink receiver (300, 305) or porous conveyor belt (500). The angle of chamfered apertures is preferably between 15 and 75 degrees and more preferably between 30 and 60 degrees.

It is found that having an optimal holding down of some ink receivers (300, 305) such as cardboard; the friction of the porous conveyor belt (500) on the support layer, while transporting the ink receiver (300, 305), may be too high. To overcome this friction the manufacturing of a porous inkjet flatbed table preferably comprising the steps of attaching an air-blow chamber (470) underneath the inkjet flatbed table suitable for creating a top pressure between the porous conveyor belt (500) and the support layer by air blowing through an air-blow channel attached to a second aperture in the plate (600) and a second aperture in the base unit (400) (FIG. 7). The dimensions and amount of the air-blow channels should be sized and frequently positioned to provide sufficient top pressure but wherein the vacuum pressure still remains sufficient to hold down the ink receiver (300, 305) to the inkjet porous inkjet table by sandwiching the porous conveyor belt (500).

Another way to solve the friction of the porous conveyor belt (500) on the porous inkjet flatbed table is that the plate (600) from the present invention comprises notches suitable to preserve atmospheric pressure underneath the porous conveyor belt (500) in a part of the support layer so the porous conveyor belt (500) may easier overcome the friction of the porous conveyor belt (500) on the inkjet flatbed table while the ink receiver (300, 305) is hold down by the vacuum chamber. Yet another way to solve the friction of the porous conveyor belt (500) on the porous inkjet flatbed table is that the porous conveyor belt (500) at the backside (=side which is connected to the inkjet flatbed table) preferably comprises notches suitable to preserve atmospheric pressure underneath the porous conveyor belt (500) in some areas of the support layer. The dimensions and amount of the notches in both previous preferred embodiments should be sized and frequently positioned to provide sufficient atmospheric pressure but wherein the vacuum pressure still remains sufficient to hold down the ink receiver (300, 305) to the inkjet porous inkjet table by sandwiching the porous conveyor belt (500). The notches in both previous preferred embodiments may be circular, elliptical, square, rectangular shaped and/or grooves, such as slits, parallel with the support layer from the porous inkjet flatbed table. In another preferred embodiment the notches are chamfered so the dimension of the notches are larger at the connection side than inside the porous conveyor belt (500) or support layer to avoid damaging of the porous conveyor belt (500).

An embodiment of the present invention is also the result of a preferred embodiment of the manufacturing of the inkjet flatbed table: An inkjet flatbed table comprising a large support layer with an area of a at least 1.5 $m^2$ to support an ink receiver (300, 305) in an inkjet printing system wherein the support layer has a flatness less than 300 μm; and wherein the support layer comprises a set of plates which are fixed to a base unit (400); wherein the plates from the set of fixed plates are characterized by comprising a thermoplastic polymer resin. The number of plates in the set of plates may be one or a plurality of plates.

In a preferred embodiment of the present invention, the edges of the support layer are chamfered towards the bottom of the support layer so the dimension of the bottom from the support layer is larger than the dimension of the top from the support layer or the edges of the plate (600) are chamfered towards the bottom of the plate (600) so the dimension of the bottom from the plate (600) is larger than the dimension of the top from the plate. Such edges avoids while entering or exiting the ink receiver (300, 305) on/from the inkjet flatbed table that the backside of the ink receiver (300, 305) shall be damaged. The angle of chamfered edges is preferably between 15 and 75 degrees and more preferably between 30 and 60 degrees.

Inkjet Flatbed Table

An inkjet flatbed table is a support for an ink receiver (300, 305) while an inkjet printing system is printing on the ink receiver (300, 305). The support of ink receivers (300, 305) has to be flat to print on large ink receivers. An inkjet flatbed table comprises a base unit (400). The base unit (400) is preferably stable and robust. It comprises fixing means suitable for attaching to an inkjet printing system. To have a strong, stable and robust base unit (400), the base unit (400) comprises preferably metal such as steel or aluminium. The support layer may have any shape but is preferably rectangular shaped. The size of the support layer from the inkjet flatbed table is preferably from 2.50 until 20.0 $m^2$, more preferably from 2.80 until 15.0 $m^2$ and most preferably from 3.00 until 10.0 $m^2$. The larger the size of the support layer, the larger an ink receiver (300, 305) or more ink receivers (300, 305) can be supported which results in a production boost. Larger the size of the support layer, more difficult to achieve a flatness less than 300 μm at a cost-effective production of inkjet flatbed tables which is solved by the present invention. The width or height of the inkjet flatbed table is preferably from 1.0 m until 10 m. The larger the width and/or height, the larger the ink receiver (300, 305) may be supported by the inkjet flatbed table which is an economical benefit.

Preferably the inkjet flatbed table of the embodiment comprises a honeycomb structure plate (430) which is sandwiched between a top and bottom sandwich plate (432, 434). The top sandwich plate (432) is preferably the top of the base unit (400). The weight of such inkjet flatbed table and base unit (400) is low because the weight of a honeycomb structure is lower than a solid inkjet flatbed table, especially when the support layer of the inkjet flatbed table is at least 1.5 $m^2$. This results in easier manipulation and manufacturing of the inkjet flatbed table or inkjet printing system wherein such an inkjet flatbed table is constructed. A honeycomb structure plate (430) results also in high stability and less bending of the inkjet flatbed table (=better flatness). To achieve high stability the honeycomb structure plate (430) comprises preferably metal such as aluminium. The honeycomb cores are preferably sinusoidal or hexagonal shaped to provide maximum stiffness in several directions so the forces caused by the support of the ink receivers (300, 305) are distributed over the surface area of the support layer from the inkjet flatbed table. The flatness of the top sandwich plate (600) is preferably less than 1.2 mm and more preferably less than 0.6 mm which makes the amount of abrasion in the manufacturing method of the present invention less time-consuming.

The inkjet flatbed table in the embodiment may be wrapped by a porous conveyor belt (500), linked by minimal 2 pulleys (550, 555), wherein the porous conveyor belt (500) carries the ink receiver (300, 305) by moving from a start location to an end location. Preferably the porous conveyor belt (500) moves the ink receiver (300, 305) in successive distance movements also called discrete step increments. The inkjet flatbed table results in a flat support for the ink receiver (300, 305) on the porous conveyor belt (500) while printing.

To manufacture the inkjet flatbed table as in the present invention more easily, the base unit (400) of the inkjet flatbed table may have two apertures to be able to navigate and manipulate the inkjet flatbed table with a fork-truck for example while constructing an inkjet printing system with the inkjet flatbed table. The inner surface of the two apertures has a dimension that is suitable for a fork of a fork-truck.

The width of the printing table in the embodiment is equal to the dimension of the side of the printing table where the ink receiver (300, 305) enters on the inkjet flatbed table. The length of the porous inkjet flatbed table is equal to the dimension of the side perpendicular to the side of the printing table where the ink receiver (300, 305) enters on the inkjet flatbed table.

Porous Inkjet Flatbed Table

To avoid registration problems while printing on an ink receiver (300, 305) and to avoid collisions while conveying an ink receiver (300, 305) the ink receiver (300, 305) needs to be connected to an inkjet flatbed table. A porous inkjet flatbed table is an inkjet flatbed table wherein the ink receiver (300, 305) is connected to the inkjet flatbed table by vacuum pressure. A porous inkjet flatbed table is also called an inkjet vacuum table. Between the ink receiver (300, 305) and the porous inkjet flatbed table may be a porous conveyor belt (500) when a porous conveyor belt (500) is wrapped around the porous inkjet flatbed table.

Preferably the porous inkjet flatbed table in the embodiment comprises a set of air-suck channels to provide a pressure differential by a vacuum chamber at the support layer of the porous inkjet flatbed table to create a vacuum zone and at the bottom surface of the inkjet flatbed table a set of apertures which are connected to the set of air-suck channels. These apertures at the bottom layer may be circular, elliptical, square, rectangular shaped and/or grooves, such as slits, parallel with the bottom layer of the porous inkjet flatbed table.

The width or height of the porous inkjet flatbed table is preferably from 1.0 m until 10 m. The larger the width and/or height, the larger the ink receiver (300, 305) may be supported by the porous inkjet flatbed table which is an economical benefit.

An aperture at the bottom surface and at the support surface of the porous inkjet flatbed table may be connected to one or more air-suck channels. An aperture at the bottom surface or support surface of the porous inkjet flatbed table may be small in size, preferably from 0.3 to 12 mm in diameter, more preferably from 0.4 to 8 mm in diameter, most preferably from 0.5 to 5 mm in diameter and preferably spaced evenly apart on the porous conveyor belt (500) preferably 1 mm to 50 mm apart, more preferably from 4 to 30 mm apart and most preferably from 5 to 15 mm apart to enable the creation of uniform vacuum pressure that connects an ink receiver (300, 305) together with the porous inkjet flatbed table.

A set of apertures at the support layer of the porous inkjet flatbed table may be connected to the air-suck channels. These apertures at the support layer may be circular, elliptical, square, rectangular shaped and/or grooves, such as slits, parallel with the support layer of the porous inkjet flatbed table. Preferably if the apertures are grooves, than the grooves are oriented along the printing direction.

Preferably the porous inkjet flatbed table of the embodiment comprising a honeycomb structure plate (430) which is sandwiched between a top and bottom sandwich plate (600) which comprises each a set of apertures connect to one or more air-suck channels in the porous inkjet flatbed table. The honeycomb cores, as part of the air-suck channels, in the honeycomb structure plate (430) results in a better uniform vacuum distribution on the support surface of the porous inkjet flatbed table.

The dimensions and the amount of air-suck channels should be sized and frequently positioned to provide sufficient vacuum pressure to the porous inkjet flatbed table. Also the dimensions and the amount of apertures at the bottom surface of the porous inkjet flatbed table should be sized and frequently positioned to provide sufficient vacuum pressure to the porous inkjet flatbed table. The dimension between two air-suck channels or two apertures at the bottom surface of the porous inkjet flatbed table may be different. A honeycomb core is preferably sinusoidal or hexagonal shaped.

If a honeycomb structure plate (430) is comprised in the porous inkjet flatbed table also the dimensions and the amount of honeycomb cores should be sized and frequently positioned to provide sufficient vacuum pressure to the porous inkjet flatbed table. The dimensions between two neighbour honeycomb cores may be different.

The support layer of the inkjet flatbed table should be constructed to prevent damaging of an ink receiver (300, 305) or porous conveyor belt (500) if applicable. For example the apertures at the support layer that are connected with the air-suck channels may have rounded edges. The support layer of the inkjet flatbed table may be configured to have low frictional specifications.

The length of a porous inkjet flatbed table in the embodiment is defined by the dimension in the same direction of the longest side of the gantry that comprises one or more printheads (200). The gantry may move a printhead (200) along the longest side of the gantry.

The width of the porous inkjet flatbed table in the embodiment is the dimension in the direction perpendicular the length of the porous inkjet flatbed table.

The porous inkjet flatbed table is preferably parallel to the ground whereon the inkjet printing system is connected to avoid misaligned printed patterns.

The vacuum pressure in a vacuum zone on the support surface of the porous inkjet flatbed table may couple the ink receiver (300, 305) and the porous inkjet flatbed table by sandwiching the porous conveyor belt (500) that carries the ink receiver (300, 305). The vacuum pressure in a vacuum zone on the support surface of the porous inkjet flatbed table may apply sufficient normal force to the porous conveyor belt (500) when the porous conveyor belt (500) is moving and carrying an ink receiver (300, 305) in the conveying direction. The vacuum pressure may also prevent any fluttering and/or vibrating of the porous conveyor belt (500) or ink receiver (300, 305) on the porous conveyor belt (500). The vacuum pressure in a vacuum zone may be adapted while printing.

Flatness of an Inkjet Flatbed Table

The flatness on the top of the support layer is crucial to have good print quality on an ink receiver (300, 305) which is supported on the support layer because it influences the throw distance.

The maximum height distance in the areas on the top of the inkjet flatbed table, which do not comprise apertures and notches, relative to a plane defined by three areas on the top of the inkjet flatbed table, which don't comprising apertures and notches, defines the flatness of an inkjet flatbed table.

A flexible ink receiver (300, 305), supported by these areas on the top of the inkjet flatbed table, which don't comprising apertures and notches shall than have the same flatness as the inkjet flatbed table.

To measure the flatness of an inkjet flatbed table, several flatness measurement tools are available in the state-of-the art, for example the measurement tool disclosed in U.S. Pat. No. 6,497,047 (FUJIKOSHI KIKAI KOGYO KK).

The flatness of an inkjet flatbed table can also be measured by surface profilometers such as the KLA-Tencor™ series of bench top stylus and optical surface profilometers.

Vacuum Chamber

A vacuum chamber is a rigid enclosure which is constructed by many materials preferably it may comprise a metal. The choice of the material is based on the strength, pressure and the permeability. The material of the vacuum chamber may comprise stainless steel, aluminium, mild steel, brass, high density ceramic, glass or acrylic.

A vacuum pump provides a vacuum pressure inside a vacuum chamber and is connected by a vacuum pump connector, such as a tube, to a vacuum pump input such as aperture in the vacuum chamber. Between the vacuum pump connector a vacuum controller, such as a valve or a tap, may be provided to control the vacuum in a sub-vacuum chamber wherein the aperture is positioned.

To prevent contamination, such as paper dust, ink receiver (300, 305) fibers, ink, ink residues and/or ink debris such as cured ink, to contaminate via the air-suck channels of the porous inkjet flatbed table the interior means of the vacuum pump, a filter, such as an air filter and/or coalescence filter, may be connected to the vacuum pump connector. Preferably a coalescence filter, as filter, is connected to the vacuum pump connector to split liquid and air from the contamination in the vacuum pump connector.

The width of a vacuum chamber, which is in the same direction of the width of the above porous inkjet flatbed table, may be smaller to make the possibilities to create place underneath the inkjet flatbed table for means such as a vacuum pump or a vacuum pump connector.

The length of a vacuum chamber, which is in the same direction of the length of the above porous inkjet flatbed table, may be smaller to make the possibilities to create place underneath the inkjet flatbed table for means such as a vacuum pump or a vacuum pump connector.

Printhead

A printhead (200) is a means for jetting a liquid on an ink receiver (300, 305) through a nozzle. The nozzle may be comprised in a nozzle plate (600) which is attached to the printhead (200). A set of liquid channels, comprised in the printhead (200), corresponds to a nozzle of the printhead (200) which means that the liquid in the set of liquid channels can leave the corresponding nozzle in the jetting method. The liquid is preferably an ink, more preferably an UV curable inkjet ink or water based inkjet ink, such as a water based resin inkjet ink. The liquid used to jet by a printhead (200) is also called a jettable liquid.

The way to incorporate printheads (200) into an inkjet printing system is well-known to the skilled person.

A printhead (200) may be any type of printhead such as a valvejet printhead, piezoelectric printhead, thermal printhead, a continuous printhead type, electrostatic drop on demand printhead type or acoustic drop on demand printhead type or a page-wide printhead array, also called a page-wide inkjet array.

A printhead (200) comprises a set of master inlets to provide the printhead (200) with a liquid from a set of external liquid feeding units. Preferably the printhead (200) comprises a set of master outlets to perform a recirculation of the liquid through the printhead (200). The recirculation may be done before the droplet forming means but it is more preferred that the recirculation is done in the printhead (200) itself, so called through-flow printheads (200). The continuous flow of the liquid in a through-flow printheads (200) removes air bubbles and agglomerated particles from the liquid channels of the printhead (200), thereby avoiding blocked nozzles that prevent jetting of the liquid. The continuous flow prevents sedimentation and ensures a consistent jetting temperature and jetting viscosity. It also facilitates auto-recovery of blocked nozzles which minimizes liquid and ink receiver wastage. The recirculation of a liquid results also in less inertia of the liquid. In a more preferred embodiment the printhead (200) is a through-flow piezoelectric printhead or through-flow valvejet printhead, wherein the high viscosity liquid is recirculated in a continuous flow through a liquid transport channel where the pressure to the liquid is applied by a droplet forming means and wherein the liquid transport channel is in contact with the nozzle plate. In a most preferred embodiment the droplet forming means in these printheads applies a pressure in the same direction as the jetting directions towards the ink receiver (300, 305) to activate a straight flow of pressurized liquid to enter the nozzle that corresponds to the droplet forming means. The advantage of such through-flow printheads is a better dot-placement on an ink-receiver than the non through-flow printheads for example by less sedimentations in the printhead.

The number of master inlets in the set of master inlets is preferably from 1 to 12 master inlets, more preferably from 1 to 6 master inlets and most preferably from 1 to 4 master inlets. The set of liquid channels that corresponds to the nozzle are replenished via one or more master inlets of the set of master inlets.

The amount of master outlets in the set of master outlets in a through-flow printhead is preferably from 1 to 12 master outlets, more preferably from 1 to 6 master outlets and most preferably from 1 to 4 master outlets.

In a preferred embodiment prior to the replenishing of a set of liquid channels, a set of liquids is mixed to a jettable liquid that replenishes the set of liquid channels. The mixing to a jettable liquid is preferably performed by a mixing means, also called a mixer, preferably comprised in the printhead wherein the mixing means is attached to the set of master inlets and the set of liquid channels. The mixing means may comprise a stirring device in a liquid container, such as a manifold in the printhead, wherein the set of liquids are mixed by a mixer. The mixing to a jettable liquid also means the dilution of liquids to a jettable liquid. The late mixing of a set of liquids for jettable liquid has the benefit that sedimentation can be avoided for jettable liquids of limited dispersion stability.

The liquid leaves the liquid channels by a droplet forming means, through the nozzle that corresponds to the liquid channels. The droplet forming means are comprised in the printhead. The droplet forming means are activating the liquid channels to move the liquid out the printhead through the nozzle that corresponds to the liquid channels.

The amount of liquid channels in the set of liquid channels that corresponds to a nozzle is preferably from 1 to 12, more preferably from 1 to 6 and most preferably from 1 to 4 liquid channels.

The printhead (200) of the present invention is suitable for jetting a liquid having a jetting viscosity of 5 mPa·s to 3000 mPa·s. A preferred printhead (200) is suitable for jetting a liquid having a jetting viscosity of 20 mPa·s to 200 mPa·s.

Valvejet Printhead

A preferred printhead (200) for the present invention is a so-called Valvejet printhead. Preferred valvejet printheads have a nozzle diameter between 45 and 600 μm. The valvejet printheads comprising a plurality of micro valves, allow for a resolution of 15 to 150 dpi that is preferred for having high productivity while not comprising image quality. A Valvejet printhead is also called coil package of micro valves or a dispensing module of micro valves. The way to incorporate valvejet printheads into an inkjet printing device is well-known to the skilled person. For example, US 2012105522 (MATTHEWS RESOURCES INC) discloses a valvejet printer including a solenoid coil and a plunger rod having a magnetically susceptible shank. Suitable commercial valvejet printheads are chromoJET™ 200, 400 and 800 from Zimmer, Printos™ P16 from VideoJet and the coil packages of micro valve SMLD 300's from Fritz Gyger™. A nozzle plate (600) of a Valvejet printhead is often called a faceplate and is preferably made from stainless steel.

The droplet forming means of a Valvejet printhead controls each micro valve in the Valvejet printhead by actuating electromagnetically to close or to open the micro valve so that the medium flows through the liquid channel. Valvejet printheads preferably have a maximum dispensing frequency up to 3000 Hz.

In a preferred embodiment the Valvejet printhead the minimum drop size of one single droplet, also called minimal dispensing volume, is from 1 nL (=nanoliter) to 500 μL (=microliter), in a more preferred embodiment the minimum drop size is from 10 nL to 50 μL, in a most preferred embodiment the minimum drop size is from 10 nL to 300 μL. By using multiple single droplets, higher drop sizes may be achieved.

In a preferred embodiment the Valvejet printhead has a native print resolution from 10 DPI to 300 DPI, in a more preferred embodiment the Valvejet printhead has a native print resolution from 20 DPI to 200 DPI and in a most preferred embodiment the Valvejet printhead has a native print resolution from 50 DPI to 200 DPI.

In a preferred embodiment with the Valvejet printhead the jetting viscosity is from 5 mPa·s to 3000 mPa·s more preferably from 25 mPa·s to 1000 mPa·s and most preferably from 30 mPa·s to 500 mPa·s.

In a preferred embodiment with the Valvejet printhead the jetting temperature is from 10° C. to 100° C. more preferably from 20° C. to 60° C. and most preferably from 25° C. to 50° C.

Piezoelectric Printheads

Another preferred printhead (200) of the embodiment is a piezoelectric printhead. Piezoelectric printhead, also called piezoelectric inkjet printhead (200), is based on the movement of a piezoelectric ceramic transducer, comprised in the printhead, when a voltage is applied thereto. The application of a voltage changes the shape of the piezoelectric ceramic transducer to create a void in a liquid channel, which is then filled with liquid. When the voltage is again removed, the ceramic expands to its original shape, ejecting a droplet of liquid from the liquid channel.

The droplet forming means of a piezoelectric printhead controls a set of piezoelectric ceramic transducers to apply a voltage to change the shape of a piezoelectric ceramic transducer. The droplet forming means may be a squeeze mode actuator, a bend mode actuator, a push mode actuator or a shear mode actuator or another type of piezoelectric actuator. Suitable commercial piezoelectric printheads are TOSHIBA TEC™ CK1 and CK1L from TOSHIBA TEC™ (https://www.toshibatec.co.jp/en/products/industrial/inkjet/products/cf1/) and XAAR™ 1002 from XAAR™ (http://www.xaar.com/en/products/xaar-1002).

A liquid channel in a piezoelectric printhead is also called a pressure chamber.

Between a liquid channel and a master inlet of the piezoelectric printheads, there is a manifold connected to store the liquid to supply to the set of liquid channels.

The piezoelectric printhead is preferably a through-flow piezoelectric printhead. In a preferred embodiment the recirculation of the liquid in a through-flow piezoelectric printhead flows between a set of liquid channels and the inlet of the nozzle wherein the set of liquid channels corresponds to the nozzle.

In a preferred embodiment in a piezoelectric printhead the minimum drop size of one single jetted droplet is from 0.1 μL to 100 nL, in a more preferred embodiment the minimum drop size is from 1 μL to 150 μL, in a most preferred embodiment the minimum drop size is from 1.5 μL to 15 μL. By using grayscale inkjet head technology multiple single droplets may form larger drop sizes. Minimum drop size of one single jetted droplet larger than 50 μL by a piezoelectric printhead, such as the Xaar™ 001, is used in the digitalization of ceramics manufacturing processes.

In a preferred embodiment the piezoelectric printhead has a drop velocity from 3 meters per second to 15 meters per second, in a more preferred embodiment the drop velocity is from 5 meters per second to 10 meters per second, in a most preferred embodiment the drop velocity is from 6 meters per second to 8 meters per second.

In a preferred embodiment the piezoelectric printhead has a native print resolution from 25 DPI to 2400 DPI, in a more preferred embodiment the piezoelectric printhead has a native print resolution from 50 DPI to 2400 DPI and in a most preferred embodiment the piezoelectric printhead has a native print resolution from 150 DPI to 3600 DPI.

In a preferred embodiment with the piezoelectric printhead the jetting viscosity is from 5 mPa·s to 200 mPa·s more preferably from 25 mPa·s to 100 mPa·s and most preferably from 30 mPa·s to 70 mPa·s.

In a preferred embodiment with the piezoelectric printhead the jetting temperature is from 10° C. to 100° C. more preferably from 20° C. to 60° C. and most preferably from 30° C. to 50° C.

The nozzle spacing distance of the nozzle row in a piezoelectric printhead is preferably from 10 μm to 200 μm; more preferably from 10 μm to 85 μm; and most preferably from 10 μm to 45 μm.

Inkjet Printing System

The inkjet flatbed table in the present invention is comprised in an inkjet printing system wherein a printhead (200) is attached to jet a liquid, such as an inkjet ink, on an ink receiver (300, 305). The manufacturing of an inkjet flatbed table is preferably comprised in a manufacturing of an inkjet printing system.

The way to incorporate printheads (200) into an inkjet printing system is well-known to the skilled person. More information about inkjet printing systems is disclosed in STEPHEN F. POND. Inkjet technology and Product development strategies. United States of America: Torrey Pines Research, 2000, ISBN 0970086008.

An inkjet printing system, such as an inkjet printer, is a marking device that is using a printhead (200) or a printhead (200) assembly with one or more printheads (200), which jets ink on an ink receiver (300, 305). A pattern that is marked by jetting of the inkjet printing system on an ink receiver (300, 305) is preferably an image. The pattern may be achromatic or chromatic colour.

The ink-receiver transport direction is also called the printing direction and if the ink receiver (300, 305) is transported by a porous conveyor belt (500), the ink-receiver transport direction is also called the conveying direction.

A preferred embodiment is that the inkjet printing system is an inkjet printer and more preferably a wide format inkjet printer. Wide format inkjet printers are generally accepted to be any inkjet printer with a print width over 17 inches. Digital printers with a print width over the 100 inch are generally called super-wide printers or grand format printers. Wide format printers are mostly used to print banners, posters, textiles and general signage and in some cases may be more economical than short-run methods such as screen printing. Wide format printers generally use a roll of ink receiver (300, 305) rather than individual sheets of ink receiver (300, 305) but today also wide format printers exist with an inkjet flatbed table whereon ink receiver (300, 305) is supported. The printing direction of a wide format inkjet printer is also called the slow-scan direction.

The inkjet flatbed table of the present invention in an inkjet printing system may move under a printhead (200) and/or a gantry may move a printhead (200) over the inkjet flatbed table. These so called flat-table digital printers most often are used for the printing of planar ink receivers, ridged ink receivers and sheets of flexible ink receivers. They may incorporate IR-dryers or UV-dryers to prevent prints from sticking to each other as they are produced. An example of a wide format printer and more specific a flat-table digital printer is disclosed in EP1881903 B (AGFA GRAPHICS NV).

In a single pass printing method the inkjet printheads (200) usually remain stationary and the ink receiver (300, 305) surface is transported once under the one or more inkjet printheads (200). In a single pass printing method the method may be performed by using page wide inkjet printheads (200) or multiple staggered inkjet printheads (200) which cover the entire width of the ink receiver (300, 305). An example of a single pass printing method is disclosed in EP 2633998 A (AGFA GRAPHICS NV). The inkjet printing system is in a preferred embodiment a single-pass inkjet printing system. An inkjet flatbed table as in the present invention is an advantage in a single-pass inkjet printing system due to the low flatness so the dot-placement accuracy is higher than the state-of-the-art inkjet flatbed tables.

The inkjet printing system may mark a broad range of ink receivers (300, 305): sheet-shaped or web-shaped. An ink receiver (300, 305) may be folding carton, acrylic plates, honeycomb board, corrugated board, foam, medium density fibreboard, solid board, rigid paper board, fluted core board, plastics, aluminium composite material, foam board, corrugated plastic, carpet, textile, thin aluminium, paper, rubber, adhesives, vinyl, veneer, varnish blankets, wood, flexographic plates, metal based plates, fibreglass, transparency foils or adhesive PVC sheets.

The inkjet printing system may comprise a step belt conveyor which is a piece of mechanical handling equipment that carries an ink receiver (300, 305) by moving from a start location to an end location via a porous conveyor belt (500) in successive distance movements, also called discrete step increments. The direction movement from the start location to the end location is called the printing direction or conveying direction. The porous conveyor belt (500) is linked between a plurality of pulleys (550, 555) wherein the porous conveyor belt (500) rotates around the plurality of pulleys (550, 555). An example of a general belt conveyor system comprising a vacuum table to hold an ink receiver (300, 305) while printing and wherein the vacuum table comprises pneumatic cleaning devices is disclosed in US 20100271425(A1) (XEROX CORPORATION).

Preferably the inkjet printing system comprises one or more printheads (200) jetting UV curable ink to mark an ink receiver (300, 305) and a UV source, as dryer system, to cure the inks after marking. Spreading of a UV curable inkjet ink on an ink receiver (300, 305) may be controlled by a partial curing or "pin curing" treatment wherein the ink droplet is "pinned", i.e. immobilized where after no further spreading occurs. For example, WO 2004/002746 (INCA) discloses an inkjet printing method of printing an area of an ink receiver (300, 305) in a plurality of passes using curable ink, the method comprising depositing a first pass of ink on the area; partially curing ink deposited in the first pass; depositing a second pass of ink on the area; and fully curing the ink on the area.

A preferred configuration of UV source is a mercury vapour lamp. Within a quartz glass tube containing e.g. charged mercury, energy is added, and the mercury is vaporized and ionized. As a result of the vaporization and ionization, the high-energy free-for-all of mercury atoms, ions, and free electrons results in excited states of many of the mercury atoms and ions. As they settle back down to their ground state, radiation is emitted. By controlling the pressure that exists in the lamp, the wavelength of the radiation that is emitted can be somewhat accurately controlled, the goal being of course to ensure that much of the radiation that is emitted falls in the ultraviolet portion of the spectrum, and at wavelengths that will be effective for UV curable ink curing. Another preferred UV source is an UV-Light Emitting Diode, also called an UV-LED.

The inkjet printing system that performs the embodiment may be used to create a structure through a sequential layering process by jetting sequential layers, also called additive manufacturing or 3D inkjet printing. So the method of the present invention is preferably comprised in a 3D inkjet printing method. The objects that may be manufactured additively by the embodiment can be used anywhere throughout the product life cycle, from pre-production (i.e. rapid prototyping) to full-scale production (i.e. rapid manufacturing), in addition to tooling applications and post-production customization. The hardness, wear resistance, temperature insensitivity, stability and flatness of the inkjet flatbed table from the present invention in such inkjet printing system is an advantage in dot placement accuracy. Preferably the object jetted in additive layers by the inkjet printing system is a flexographic printing plate. An example of such a flexographic printing plate manufactured by an inkjet printing system is disclosed in EP2465678 B (AGFA GRAPHICS NV).

The inkjet printing system that performs the embodiment may be used to create relief, such as topographic structures on an object, by jetting a sequential set of layers, e.g. for manufacturing an embossing plate. An example of such relief printing is disclosed in US 20100221504 (JOERG BAUER). So the method of the present invention is preferably comprised in a relief inkjet printing method. The hardness, wear resistance, temperature insensitivity, stability and flatness of the inkjet flatbed table from the present invention in such inkjet printing system is an advantage in dot placement accuracy and better jetting quality.

The inkjet printing system of the embodiment may be used to create printing plates used for computer-to-plate (CTP) systems in which a proprietary liquid is jetted onto a metal base to create an imaged plate (600) from the digital record. So the method of the present invention is preferably comprised in an inkjet computer-to-plate manufacturing method. These plates require no processing or post-baking and can be used immediately after the ink-jet imaging is complete. Another advantage is that platesetters with an inkjet printing system is less expensive than laser or thermal equipment normally used in computer-to-plate (CTP) systems. Preferably the object that may be jetted by the embodiment is a lithographic printing plate. An example of such a lithographic printing plate (600) manufactured by an inkjet printing system is disclosed EP1179422 B (AGFA GRAPHICS NV). The hardness, wear resistance, temperature insensitivity, stability and flatness of the inkjet flatbed table from the present invention in such inkjet printing system is an advantage in dot placement accuracy and better jetting quality.

Preferably the inkjet printing system is a textile inkjet printing system, performing a textile inkjet printing method. In industrial textile inkjet printing systems, printing on multiple textiles simultaneously is an advantage for producing printed textiles in an economical manner. So the method of the present invention is preferably comprised in a textile printing method by using a printhead (200). The hardness, wear resistance, temperature insensitivity, stability and flatness of the inkjet flatbed table from the present invention in such inkjet printing system is an advantage in dot placement accuracy and better jetting quality.

Preferably the inkjet printing system is a ceramic inkjet printing system, performing a ceramic inkjet printing method. In ceramic inkjet printing systems printing on multiple ceramics simultaneously is an advantage for producing printed ceramics in an economical manner. So the method of the present invention is preferably comprised in a printing method on ceramics by using a printhead (200). The hardness, wear resistance, temperature insensitivity, stability and flatness of the inkjet flatbed table from the present invention in such inkjet printing system is an advantage in dot placement accuracy and better jetting quality.

Preferably the inkjet printing system is a glass inkjet printing system, performing a glass inkjet printing method. In glass inkjet printing systems printing on multiple glasses simultaneous is an advantage for producing printed glasses in an economical manner. The hardness, wear resistance, temperature insensitivity, stability and flatness of the inkjet flatbed table from the present invention in such inkjet printing system is an advantage in dot placement accuracy and better jetting quality.

Preferably the inkjet printing system is a decoration inkjet printing system, performing a decoration inkjet printing method, to create digital printed wallpaper, laminate, digital printed objects such as flat workpieces, bottles, butter boats or crowns of bottles.

Preferably the inkjet printing system is comprised in an electronic circuit manufacturing system and the method of the present invention is comprised in an electronic circuit manufacturing method wherein the liquid is an inkjet liquid with conductive particles, often generally called conductive inkjet liquid.

The embodiment is preferably comprised in a manufacturing of an industrial inkjet printing system such as a textile inkjet printing system, ceramic inkjet printing system, glass inkjet printing system, decoration inkjet printing system.

The inkjet flatbed table in the present invention is preferably comprised in an industrial inkjet printing system such as a textile inkjet printing system, ceramic inkjet printing system, glass inkjet printing system, decoration inkjet printing system.

Inkjet Ink

In a preferred embodiment, the liquid is an ink, such as an inkjet ink, and in a more preferred embodiment the inkjet ink is an aqueous curable inkjet ink, and in a most preferred embodiment the inkjet ink is an UV curable inkjet ink.

A preferred aqueous curable inkjet ink includes an aqueous medium and polymer nanoparticles charged with a polymerizable compound. The polymerizable compound is preferably selected from the group consisting of a monomer, an oligomer, a polymerizable photoinitiator, and a polymerizable co-initiator.

An inkjet ink may be a colourless inkjet ink and be used, for example, as a primer to improve adhesion or as a varnish to obtain the desired gloss. However, preferably the inkjet ink includes at least one colorant, more preferably a colour pigment.

The inkjet ink may be a cyan, magenta, yellow, black, red, green, blue, orange or a spot color inkjet ink, preferable a corporate spot color inkjet ink such as red colour inkjet ink of Coca-Cola™ and the blue colour inkjet inks of VISA™ or KLM™.

In a preferred embodiment the liquid is an inkjet ink comprising metallic particles or comprising inorganic particles such as a white inkjet ink.

Porous Conveyor Belt

Preferably the porous conveyor belt (500) has two or more layers of materials wherein an under layer provides linear strength and shape, also called the carcass and an upper layer called the cover or the support side. The carcass is preferably a woven fabric web and more preferably a woven fabric web of polyester, nylon, glass fabric or cotton. The material of the cover is preferably various rubber and more preferably plastic compounds and most preferably thermoplastic polymer resins. But also other exotic materials for the cover can be used such as silicone or gum rubber when traction is essential. An example of a multi-layered porous conveyor belt (500) for a general belt conveyor system wherein the cover having a gel coating is disclosed in US 20090098385 A1 (FORBO SIEBLING GMBH).

Preferably the porous conveyor belt (500) comprises glass fabric or the carcass is glass fabric and more preferably the glass fabric, as carcass, has a coated layer on top comprising a thermoplastic polymer resin and most preferably the glass fabric has a coated layer on top comprising polyethylene terephthalate (PET), polyamide (PA), high-density polyethylene (HDPE), polytetrafluoroethylene (PTFE), polyoxymethylene (POM), polyurethaan (PU) and/or Polyaryletherketone (PAEK). The coated layer may also comprise aliphatic polyamides, polyamide 11 (PA 11), polyamide 12 (PA 12), UHM-HDPE, HM-HDPE, Polypropylene (PP), Polyvinyl chloride (PVC), Polysulfone (PS), Poly(p-phenylene oxide) (PPO™), Polybutylene terephthalate (PBT), Polycarbonate (PC), Polyphenylene sulphide (PPS).

Preferably the porous conveyor belt (500) is and endless porous conveyor belt (500). Examples and figures for manufacturing an endless multi-layered porous conveyor belt (500) for a general belt conveyor system are disclosed in EP 1669635 B (FORBO SIEBLING GMBH).

The porous conveyor belt (500) may also have a sticky cover which holds the ink receiver (300, 305) on the porous conveyor belt (500) while it is carried from start location to end location. Said porous conveyor belt (500) is also called a sticky porous conveyor belt (500). The advantageous effect of using a sticky porous conveyor belt (500) allows an exact positioning of an ink receiver (300, 305) on the sticky porous conveyor belt (500). Another advantageous effect is that the ink receiver (300, 305) shall not be stretched and/or deformed while the ink receiver (300, 305) is carried from start location to end location. The adhesive on the cover is preferably activated by an infrared drier to make the porous conveyor belt (500) sticky. The adhesive on the cover is more preferably a removable pressure sensitive adhesive.

Another preferable way of a sticky porous conveyor belt (500) is a porous conveyor belt (500) which comprises synthetic setae to hold an ink receiver (300, 305) stable while printing on an ink receiver (300, 305). Holding the ink receiver (300, 305) stable while printing on the ink receiver (300, 305) is necessary e.g. to avoid misalignment or color shifts in the printed pattern on the ink receiver (300, 305). The synthetic setae are emulations of setae found on the toes of geckos.

To have a better holding of an ink receiver (300, 305) together with the porous conveyor belt (500) in an inkjet flatbed table where a vacuum chamber underneath is attached, the porous conveyor belt (500) has than a plurality of holes so that the air can be directed and sucked through the porous conveyor belt (500). The plurality of these holes may be small in size, preferably from 0.3 to 10 mm in diameter, more preferably from 0.4 to 5 mm in diameter, most preferably from 0.5 to 2 mm in diameter and preferably spaced evenly apart on the porous conveyor belt (500) preferably 3 mm to 50 mm apart, more preferably from 4 to 30 mm apart and most preferably from 5 to 15 mm apart to enable the creation of uniform vacuum pressure that holds the ink receiver (300, 305) together with the porous conveyor belt (500). Smaller the apertures in the porous conveyor belt (500), higher the vacuum pressure at the top of the porous conveyor belt (500) It was found that in a porous conveyor belt (500) which comprises a carcass in glass fabric and holes smaller than 3 mm gives a superb vacuum to hold down the ink receiver (300, 305) versus the state-of-the-art. The advantage of glass fabric web versus other fabric web, as carcass in a porous conveyor belt (500), makes it easier to drill small holes smaller than 3 mm in diameter without remaining fibres at the edges of the holes after drilling. If fibres remain at the edges of the holes, the vacuum pressure is influenced badly to hold down the ink receivers (300, 305).

Other Embodiments

The present invention comprises also an inkjet printing method on an ink receiver (300, 305) in an inkjet printing system with an inkjet flatbed table and a porous conveyor belt (500), linked to a plurality of pulleys (550, 555) and wrapped around the inkjet flatbed table, to transport the ink receiver (300, 305); and wherein air is blow via an air-blow channel to the top of the support-layer pressure at the moment the ink receiver (300, 305) is transported underneath a printhead (200) of the inkjet printing system while an ink receiver (300, 305) is hold down by vacuum pressure. In a preferred embodiment of the inkjet printing method the blowing of the air is stopped while jetting ink on the ink receiver (300, 305) to prevent that the ink receiver (300, 305) is released from the inkjet printing support while printing. The advantage of air blowing is to overcome the friction of the porous conveyor belt (500) on the inkjet printing support while transporting the ink receiver (300, 305) while the ink receiver (300, 305) is hold down on the porous conveyor belt (500). In a preferred embodiment the porous inkjet flatbed table is manufactured as in the present invention.

The present invention comprises also a porous conveyor belt (500) for transporting ink receivers (300, 305) in an inkjet printing system wherein the porous conveyor belt (500) has a carcass of glass fabric web. In a more preferred embodiment the porous conveyor belt (500) comprises small apertures, between 0.3 and 5 mm to have a high vacuum pressure at the top of the porous conveyor belt (500). In a more preferred embodiment the porous conveyor belt (500) comprises a coated layer on top comprising a thermoplastic polymer resin and in a most preferred embodiment the porous conveyor belt (500) comprises a coated layer on top comprising polyethylene terephthalate (PET), polyamide (PA), high-density polyethylene (HDPE), polytetrafluoroethylene (PTFE), polyoxymethylene (POM), polyurethaan (PU) and/or Polyaryletherketone (PAEK). The coated layer may also comprise aliphatic polyamides, polyamide 11 (PA 11), polyamide 12 (PA 12), UHM-HDPE, HM-HDPE, Polypropylene (PP), Polyvinyl chloride (PVC), Polysulfone (PS), Poly(p-phenylene oxide) (PPO™), Polybutylene terephthalate (PBT), Polycarbonate (PC), Polyphenylene sulphide (PPS). In another preferred embodiment the porous conveyor belt (500) is wrapped around an inkjet flatbed table as manufactured in the present invention.

The present invention comprises also an inkjet printing system wherein an inkjet flatbed table is attached to support its ink receivers (300, 305) and wherein the inkjet flatbed table is manufactured as the present invention. In a preferred embodiment the inkjet printing system is a textile inkjet printing system, ceramic inkjet printing system, glass inkjet printing system, decoration inkjet printing system or inkjet CTP system.

EXAMPLE

This example discloses the manufacturing of inkjet flatbed tables as in the present invention.

Before fixing elf plates (600) on the base unit (400) the base unit was aligned on three reference points which in the manufacturing of the inkjet printing system shall be used to align the inkjet printing system. The base unit was fixed on three fixing means to a milling system on the same manner as it shall be fixed in the inkjet printing system and three other fixing means with minimal stress on the base unit to have less vibration as possible and not to deflect the base unit (400) by its weight. The base unit (400) comprised a honeycomb structure plate (430), which was sandwiched by a bottom plate and top plate whereon the plates are fixed. The top plate had a flatness less than 1 mm.

Figure 9:
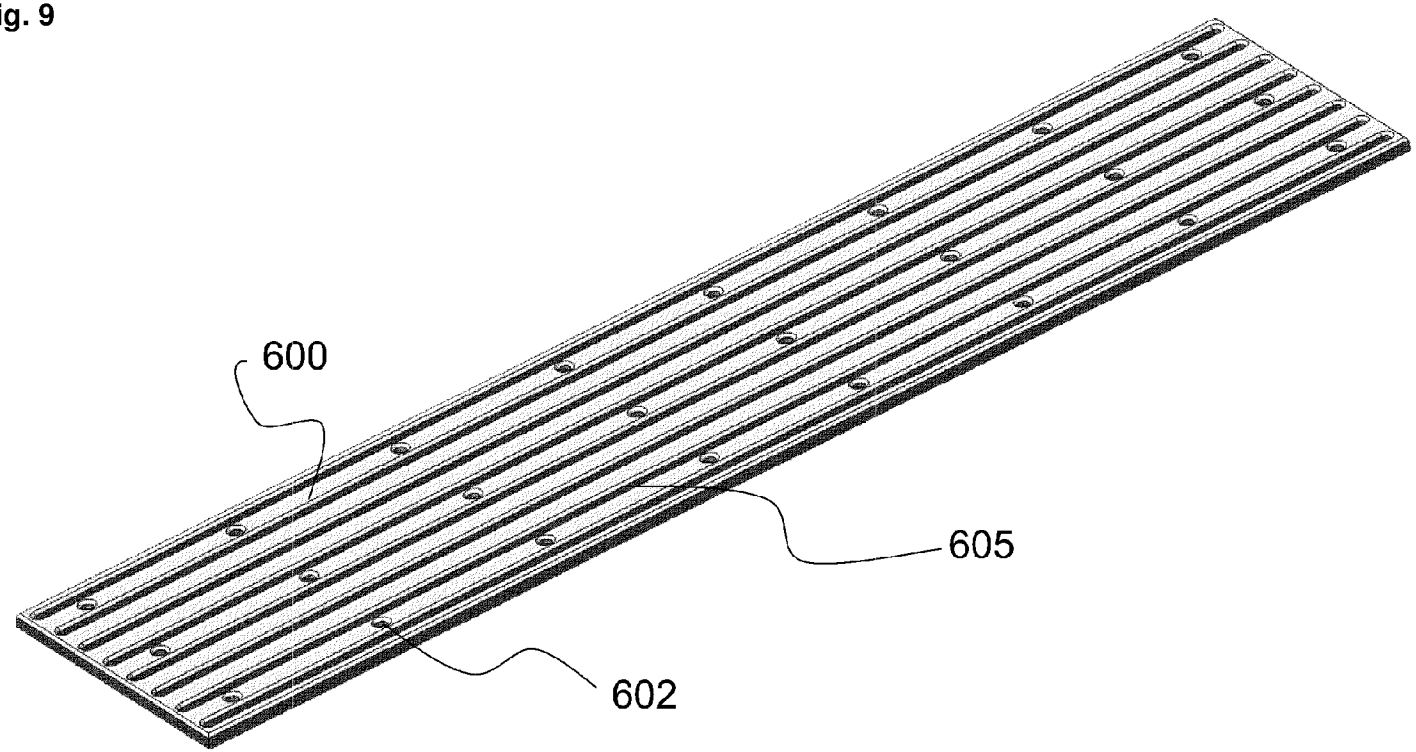
FIG. 9 illustrates a top view of a plate (600) comprising PET with a dimension of 240.6×1127 mm×12 mm. The plate (600) comprises 8×3 screw holes and 8 air-sucking-apertures in the shape of long grooves. The screw holes and air-sucking apertures are chamfered with 45 degrees and the edges of the plate are also chamfered with 45 degrees.

The plates (600) were made of modified type PET-GL from Licharz™ with a thickness of 12 mm and were fixed by screws and by epoxy glue Loctite™ Hysol 9492 which has good resistance properties. The dimension of each plate was of 240.6×1127 mm×12 mm (FIG. 9). Each plate (600) comprises 8×3 screw holes and 8 air-sucking-apertures in the shape of long grooves. The screw holes and air-sucking apertures are chamfered with 45 degrees and the edges of the plate are also chamfered with 45 degrees. The total dimension of the fixed plates to form the support layer is 1127×2656 mm.

To abrade the plate of the present invention to achieve a flatness less than 300 μm the following tools were used:

milling cutter with diameter 63 mm (brand: Walter; type: F4042) with 6 insert cutters; and a probe used, provided from M&H Hexagon™ metrology and connected with software from the same company: M&H 3D Form Inspect Software version 2.5.

The abrading was made by 2 steps: the first step is roughing to keep out the major part of the modified type PET-GL and a last step to finish the surface of the plate to a flatness below 40 μm. The time to achieve such a flatness by abrading was between 1.5 hours and 2 hours. The milling cutter was always rotating in the same direction and in the direction to put out the chips from the milling area.

The following table (Table 1) shows the flatness of three inkjet flatbed tables which were manufactured as described above. By measuring the heights in a number of positions across the inkjet flatbed table by the probe the flatness of the inkjet flatbed table is determined.

TABLE 1

| Inkjet flatbed table Number | Flatness | Amount measured positions |
|---|---|---|
| 1 | 0.025 mm | 161 |
| 2 | 0.037 mm | 161 |
| 3 | 0.031 mm | 156 |

REFERENCE SIGNS LIST

| | |
|---|---|
| 100 | Inkjet printer system |
| 200 | printhead |
| 250 | ink |
| 300 | Ink receiver |
| 305 | Ink receiver |
| 350 | Ink layer |
| 370 | Transport direction |
| 400 | Base unit |
| 430 | Honeycomb structure plate |
| 432 | Top plate |
| 434 | Bottom plate |
| 450 | Vacuum chamber |
| 470 | Air-blow chamber |
| 500 | Porous conveyor belt |
| 550 | Pulley |
| 555 | Pulley |
| 600 | Plate |

The invention claimed is:

1. A method of manufacturing an inkjet flatbed table including a support layer having an area of at least 1.5 $m^2$ to support an ink receiver in an inkjet printing system, the method comprising the steps of:

fixing a plate on top of a base to define a portion or an entirety of the support layer; and abrading the fixed plate to have a flatness on a top of the support layer less than 300 μm; wherein the plate includes a thermoplastic polymer resin.

2. The method of manufacturing an inkjet flatbed table according to claim 1, wherein the plate includes an engineering plastic composition or polyethylene terephthalate (PET), polyamide (PA), high-density polyethylene (HDPE), polytetrafluoroethylene (PTFE), polyoxymethylene (POM), and/or Polyaryletherketone (PAEK).

3. The method of manufacturing an inkjet flatbed table according to claim 1, wherein the base includes a plate including a honeycomb structure.

4. The method of manufacturing an inkjet flatbed table according to claim 1, wherein the step of abrading the fixed plate includes:

abrading the fixed plate such that the support layer is parallel or substantially parallel to a reference plane which is determined by a set of reference points in or on the base.

5. The method of manufacturing an inkjet flatbed table according to claim 1, further comprising the step of:

attaching a vacuum chamber underneath the inkjet flatbed table to create a vacuum pressure between an ink receiver and the inkjet flatbed table by sucking air through a channel attached to an aperture in the plate and to an aperture in the base; wherein the inkjet flatbed table is porous.

6. The method of manufacturing an inkjet flatbed table according to claim 5, wherein the aperture in the plate includes a chamfered outlet in a top of the plate.

7. The method of manufacturing an inkjet flatbed table according to claim 5, further comprising the step of:

wrapping a porous conveyor belt around the inkjet flatbed table; wherein the porous conveyor belt is operatively connected to a plurality of pulleys.

8. The method of manufacturing an inkjet flatbed table according to claim 7, further comprising the step of:

attaching an air-blowing chamber underneath the inkjet flatbed table to create a pressure between the porous conveyor belt and the inkjet flatbed table by blowing air through a channel attached to another aperture in the plate and to another aperture in the base.

9. The method of manufacturing an inkjet flatbed table according to claim 1, wherein the step of fixing the plate includes gluing and/or screwing the plate on top of the base.

10. An inkjet flatbed table comprising:

a support layer with an area of at least 1.5 $m^2$ to support an ink receiver, the support layer including a set of plates including a thermoplastic polymer resin; and a base; wherein the support layer has a flatness less than 300 μm;

the set of plates are fixed to the base;

the set of fixed plates fixed to the base include abraded surfaces.

11. The inkjet flatbed table according to claim 10, wherein each plate of the set of plates includes an engineering plastic.

12. The inkjet flatbed table according to claim 10, wherein the base includes a plate including a honeycomb structure.

13. The inkjet flatbed table according to claim 10, wherein the inkjet flatbed table is porous and includes:

a vacuum chamber underneath the inkjet flatbed table to create a vacuum chamber between the ink receiver and the inkjet flatbed table by sucking air through a channel attached to an aperture in the plate and to an aperture in the base; wherein the aperture in the plate includes a chamfered outlet at a top of the plate.

14. The inkjet flatbed table according to claim 13, further comprising:

a porous conveyor belt wrapped around the inkjet flatbed table; wherein the conveyor is operatively connected to a plurality of pulleys.

15. The inkjet flatbed table according to claim 14, further comprising:

an air blower underneath the inkjet flatbed table to create a pressure between the porous conveyor belt and the inkjet flatbed table by blowing air through a channel attached to another aperture in the plate and to another aperture in the base.

* * * * *